US006367387B1

(12) United States Patent
Krüper

(10) Patent No.: US 6,367,387 B1
(45) Date of Patent: Apr. 9, 2002

(54) LOW-CALIBRE SHOT GUN BULLET, ESPECIALLY FOR SHOT GUNS WITH A PARTIALLY OR FULLY DISTENDED BARREL

(75) Inventor: Wolfgang Krüper, Bad Driburg (DE)

(73) Assignee: Wilhelm Brenneke GmbH & Co. KG, Langenhagen (DE)

( * ) Notice: Subject to any disclaimer, the term of this patent is extended or adjusted under 35 U.S.C. 154(b) by 0 days.

(21) Appl. No.: 09/554,818

(22) PCT Filed: Oct. 29, 1998

(86) PCT No.: PCT/DE98/03157

§ 371 Date: May 19, 2000

§ 102(e) Date: May 19, 2000

(87) PCT Pub. No.: WO99/27319

PCT Pub. Date: Jun. 3, 1999

(30) Foreign Application Priority Data

Nov. 22, 1997 (DE) ..... 197 54 330

(51) Int. Cl.[7] ..... F42B 7/10

(52) U.S. Cl. ..... 102/439; 102/448; 102/517; 102/522; 244/3.26

(58) Field of Search ..... 102/501, 507–510, 102/514–519, 520–523, 439, 448; 244/3.26

(56) References Cited

U.S. PATENT DOCUMENTS

| | | | | |
|---|---|---|---|---|
| 2,303,449 A | * | 12/1942 | Fleischmann | 102/514 |
| 2,324,346 A | | 7/1943 | Albree | 102/50 |
| 4,756,255 A | * | 7/1988 | Rosenberg et al. | 102/521 |
| 4,977,834 A | | 12/1990 | Denis | 102/439 |
| H942 H | * | 8/1991 | Pardee | 244/3.26 |

FOREIGN PATENT DOCUMENTS

| | | | | |
|---|---|---|---|---|
| DE | 1703119 | | 2/1973 | |
| DE | 2444181 | | 4/1976 | |
| DE | 8809272.0 | | 7/1991 | |
| FR | 2188135 | | 1/1974 | |
| FR | 2602042 | | 1/1988 | |
| FR | 2726357 | | 5/1996 | |
| RU | 1118847 | * | 10/1984 | 102/517 |
| RU | 1141293 | * | 2/1985 | 102/439 |

* cited by examiner

*Primary Examiner*—Harold J Tudor
(74) *Attorney, Agent, or Firm*—Flanagan & Flanagan; John R. Flanagan

(57) ABSTRACT

The present invention relates to an under-calibered gun-barrel bullet, in particular for guns with a partially or fully rifled barrel, which is received by a thrust cage. The task of the present invention is providing a further such gun-barrel bullet. This task is solved thereby that the under-calibered gun-barrel bullet comprises a shell jacket (2) which, relative to its loaded position, receives a bullet core (3) displaceable in the direction of the gun-barrel end, whose displacement caused by the blast generation in the shell jacket (2), is limited by an abutment (9) whereby the final form of the gun-barrel bullet (1) is established.

11 Claims, 4 Drawing Sheets

LOW-CALIBRE SHOT GUN BULLET, ESPECIALLY FOR SHOT GUNS WITH A PARTIALLY OR FULLY DISTENDED BARREL

BACKGROUND OF THE INVENTION

The present invention relates to a shot gun cartridge, in particular for a shot gun with a rifled barrel, which cartridge has a sub-calibrated bullet accommodated in a thrust cage.

Cartridges having sub-calibered bullets with thrust cage, also called sabot, are increasingly preferred in particular for guns with an entirely or partially rifled barrel, due to the better shooting accuracy and greater target energy. Examples of cartridges with such bullets are found in the unexamined German patent application Nos. 24 44 181 and 17 03 119. After leaving the gun barrel, the thrust cage and bullet separate from each other and the latter continues its path to the target alone while the thrust cage falls to the ground after a short trajectory.

It is the task of the present invention to provide an innovation in a shot gun cartridge for use in a shot gun having a rifled barrel.

SUMMARY OF THE INVENTION

This task is solved by the provision of a shot gun cartridge having an enhanced sub-calibered bullet accommodated in a thrust cage which, in turn, is disposed in a cartridge case. The cartridge case is stationarily disposable in a shot gun and has a forward end locatable adjacent to an entry end of a rifled barrel of the shot gun. The thrust cage has a back end, an annular tubular body attached to and extending forwardly from the back end, and a front end on the annular tubular body defining a front opening. The thrust cage is disposed in the cartridge case with the front end of the thrust cage located adjacent to the forward end of the cartridge case. Also, thrust cage is movable relative to the cartridge case forwardly toward the entry end of the rifled barrel of the shot gun in response to a blast generated in the cartridge case rearwardly of and transmitted to the back end of the thrust gage. The enhanced sub-calibered bullet is disposed in the thrust cage and includes a shell jacket and a bullet core. The shell jacket is disposed in the annular tubular body of the thrust cage and has a front face disposed adjacent to the front end of the thrust cage, a rear face spaced forwardly of the back end of the thrust cage, respective forward and rearward portions connected together in a tandem arrangement with one another and extending between the front and rear faces of the shell jacket, and an axial bore defined through the shell jacket by the forward and rearward portions of the shell jacket and longitudinally extending between the front and rear faces of the shell jacket. The bore has a larger maximum cross-sectional size in the forward portion than in the rearward portion of the shell jacket and defines front and rear openings in the shell jacket at the front and rear faces thereof. The bullet core includes a front portion having a forwardly tapering configuration so as to provide a head extending forwardly through the bore in the forward portion of the shell jacket, a back portion larger in cross-sectional size than the front portion of the bullet core and the bore in the rearward portion of the shell jacket so as to provide a back plate, and an intermediate portion smaller in cross-sectional size than the bore in the forward and rearward portions of the shell jacket so as to provide a shaft extending through the rear opening of the shell jacket and between and interconnecting the head and back plate and adapted to guide slidable movement of the bullet core relative to the shell jacket from a pre-blast position providing an initial loaded form of the bullet, in which the shaft extends through and rearwardly of the rear opening of the shell jacket and supports the back plate at a location spaced rearwardly of the bore and the rear face of the shell jacket and adjacent the back end of the thrust cage with the head disposed substantially within the bore in the forward portion of the shell jacket and extending forwardly through the front openings of the shell jacket and thrust cage, to a post-blast position providing a final form of the bullet shot from the gun, in which the back plate is disposed rearwardly of the bore of the shell jacket and exteriorly of and flush against an abutment defined by the rear face of the shell jacket and the head projects forwardly of the front face of the shell jacket and the front opening therein, in response to the thrust cage being moved forwardly relative to the cartridge case in response to the blast generated in the cartridge case rearwardly of the back end of the thrust cage.

At the beginning of the generation of the blast the developing gas pressure thrusts the bullet core in the shell jacket forward up to the abutment and therewith establishes the final form of the bullet. Therewith, given the corresponding material selection for the bullet core and the shell jacket, the center of the mass is shifted toward the back which, when shooting from guns with an entirely or partially rifled barrel, ensures good shooting precision.

In the case of bullets it is customary, in view of the relatively progressive thrusting charge power used, to employ deformable intermediate means disposed between the bullet proper and the thrusting charge which are compressed during the starting gas pressure development whereby the combustion volume is enlarged and thus the gas pressure peak in reduced. Due to the displacement of the bullet core together with the thrust cage relative to the shell jacket which initially persists due to its inertia, the same effect is obtained in the bullet according to the invention. During assembling of the shell jacket and bullet core, depending on the shell volume available, these bullets can be used together with buffering or non-buffering intermediate means.

After the production of the final bullet form it must be ensured that the dynamic pressure of the air acting on the bullet trajectory does not push back the bullet core. It is understood that this can be realized by setting up a corresponding fit between the shell jacket and the bullet core such that the bullet core at the end of its displacement path is clamped in the shell jacket. This clamping effect can be attained, for example, by knurling of the bullet core which during a blast generation more or less strongly "eats into" the inner wall of the shell jacket.

A bullet embodied according to the invention offers diverse feasibilities in order to attain a cross section enlargement desired in terms of target ballistics, and also referred to as mushrooming out, of the bullet during the penetration into a target medium. For example, a mushrooming-out formation of the shell jacket is already achieved through the bullet core crushing when impinging onto a target alone. A further improvement can be attained thereby that for the shell jacket a softer material, for example copper, than for the bullet core is selected, which can comprise, for example, steel. To control the mushrooming-out behavior of the shell jacket it is also possible to vary its wall thickness correspondingly, or nominal buckling sites can be provided.

Further influencing the cross section enlargement of the bullet can comprise that the inner surface of the shell jacket and the contour of the bullet core have corresponding outformings which through the impingement and the penetration of the target medium initiate a deformation of the bullet controlled with respect to form and extent.

It is furthermore feasible to structure the forward-side end of the shell jacket to be open or concealed. The former causes a more rapid initiation of the mushrooming-out. The concealed opening delays the deformation but, due to the better form value, has external ballistic advantages and a greater depth effect in the target. The one or the other embodiment can be employed depending on the application purpose.

But even in the nondeformed state, a bullet according to the invention, compared to the known sabot bullets in diabolo form, has a 60% greater bullet cross sectional area and is a match with their strongest propelling charge in terms of the impact energy at 100 m. Therefore a bullet according to the invention also yields comparatively good results in an assessment through the KO formula developed by Taylor.

In a further embodiment of the invention the point of the bullet head has essentially the form of a slender cone. This form is possible since in the loaded state the bullet head is largely sunk into the shell jacket. With the cartridge loaded, the point of the bullet head does thereby not project above the crimped shell mouth of the cartridge such that the cartridges can be loaded without hazard into weapons with tubular magazines.

In one embodiment of the invention the bullet head at the end of the displacement of the bullet core is in contact with its outer circumference on the inner circumference of the shell jacket; that means the forward-side end face of the bullet is closed with the cone-shaped point of the bullet head projecting over this front side. This development lends the bullet a ballistically favorable form. Its ballistic coefficient is now approximately 100% greater than that of conventional gun-barrel bullets with flat head or, at best, indicated small bullet point. This leads to the fact that, compared to those bullets of identical caliber and with performance values of approximately identical magnitude at the muzzle, at a shooting distance of approximately 100 m, a markedly higher impact energy, flatter trajectory and lesser side wind sensitivity are obtained. Of advantage is also the sharp edge formed by the forward-side face of the shell jacket, which yields a caliber-size entrance hole.

The under-calibered gun-barrel bullet according to the invention, compared to the known, so-called "sabot" bullet, has the advantage of greater caliber (16 mm Ø in caliber 12) at approximately identical ballistic coefficient. It is conceived as a bullet free of harmful substances. Should for special requirements a bullet of lead be preferred, this can be realized without major problems. Fundamentally, a conversion to special suitable materials and/or application of special processing methods, such as, for example, hardening of the bullet core with modified form, permit the bullet to appear suitable for special application areas, such as for example, the government area.

The gun-barrel bullet according to the invention is conceived in particular for use in entirely or partially rifled gun barrels. Shooting from smooth gun barrels is not recommended. From rifled barrels, it yields up to the 100 m range a good shooting precision, high impact energy and high tendency for deformation. These are requirements made increasingly more frequently in recent times since in many countries the use of rifle cartridges when hunting is forbidden due to the large hazard region.

BRIEF DESCRIPTION OF THE DRAWINGS

The invention is explained in further detail in the following description of the exemplary embodiments with reference to the drawings in which.

DETAILED DESCRIPTION OF THE INVENTION

Figure 1:
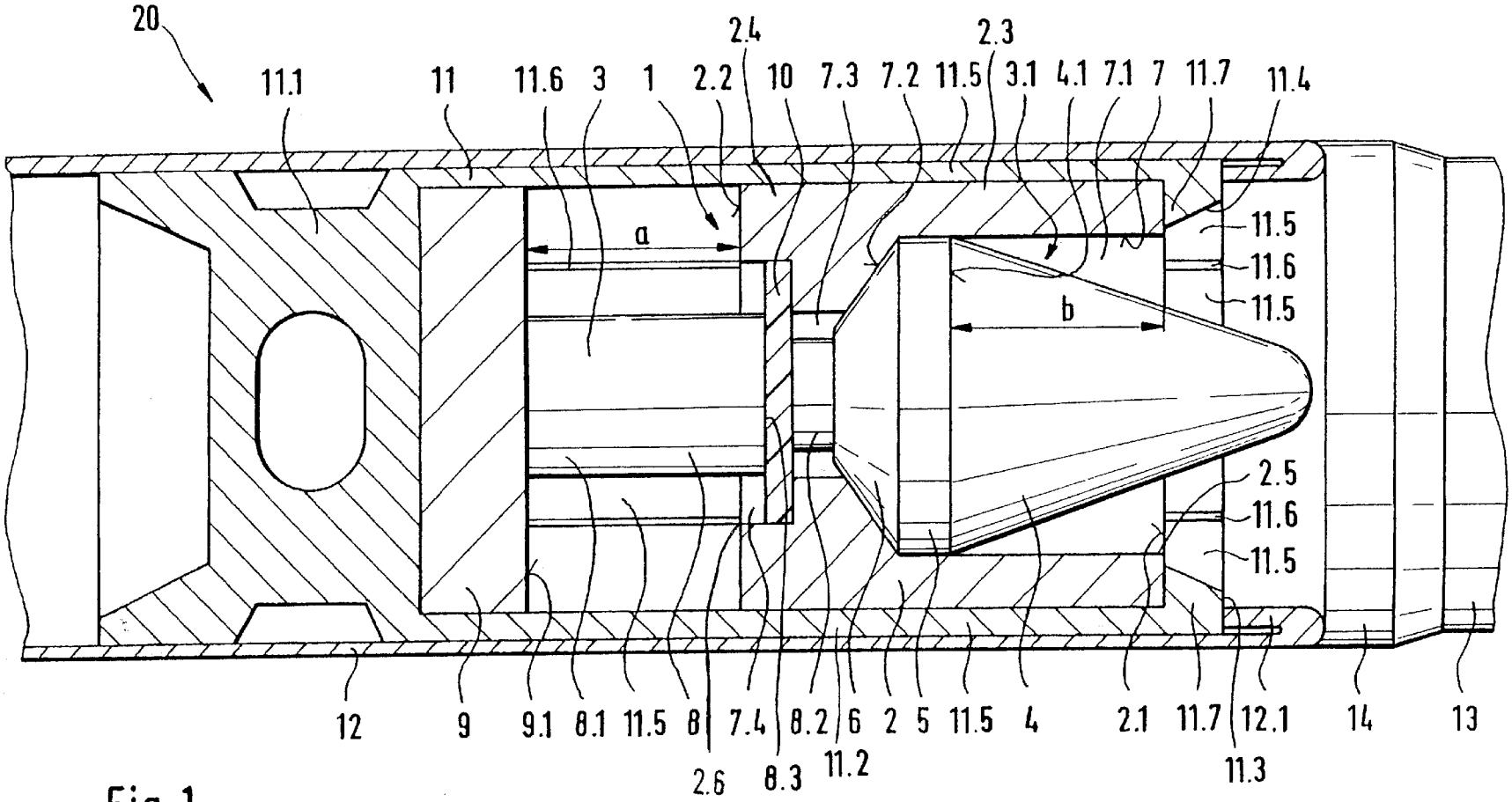
FIG. 1 is a longitudinal sectional view of one embodiment of a shot gun cartridge of the invention for a rifled shot gun barrel wherein the cartridge comprises a thrust cage and an enhanced sub-calibered bullet having a shell jacket and a bullet core, not sectioned, with the bullet being shown in an initial loaded form prior to generation of a blast.

As seen in FIG. 1, a shot gun cartridge 20 of the invention has an enhanced sub-calibered slug or bullet 1 disposed in a thrust cage 11 which, in turn, is disposed in an elongated case 12 of the cartridge 20. The bullet 1 depicted in FIGS. 1 and 2 comprises a cylindrical shell jacket 2, such as of copper, and a bullet core 3 disposed displaceably therein. The bullet core 3 comprises a bullet shaft 8 and a bullet head 3.1, with the bullet head 3.1 comprising a slender forwardly tapered cone point 4, a cylindrical segment 5 and a tail-end, truncated rearwardly tapered cone-form segment 6. To receive and guide the bullet core 3, the shell jacket 2 comprises a continuous longitudinal axial bore 7. In its front cylindrical segment 7.1 the bullet head 3.1 is guided with its cylindrical segment 5, which is in contact with corresponding play on the wall of the bore segment 7.1. At the tail end a conical transition 7.2 is provided in the longitudinal bore 7, which form-fittingly receives the truncated cone-form segment 6 of the bullet head 3.1. The longitudinal bore 7 in its adjoinment on the conical transition 7.2 changes over into a cylindrical segment 7.3 of reduced diameter which is adjoined by a cylindrical segment 7.4 with comparatively increased diameter. The bullet head 3.1 comprises a light metal or synthetic material.

In addition to its guidance in segment 7.2 of the shell jacket 2, the bullet core 3 is guided and retained by a bullet shaft 8 with a back plate 9 fastened thereon or implemented integrally with it. The bullet shaft 8 and the back plate 9 are comprised of steel or another material of corresponding strength. The bullet shaft 8 comprises a rear segment 8.1 of greater diameter and a front segment 8.2 of lesser diameter.

Into the end segment 7.4 of the longitudinal bore 7 is set a clamp disk 10 of synthetic material with a central bore through which the segment 8.2 of the bullet shaft 8 is guided for the assembly of the bullet 1 in order to be connected in a suitable manner with the bullet head 3.1. In this state (see FIG. 1) an offset 8.3 between the segments 8.1 and 8.2 of the bullet shaft 8 rests on the clamp disk 10.

In the above-described assembled state the bullet 1 is introduced into the thrust cage 11 and loaded together therewith into the case 12 of the cartridge 20. The cartridge case 12 is stationarily disposable in a shot gun and has a forward end 12.1 locatable adjacent to an entry end of a rifled barrel 13 of the shot gun. The thrust cage 11 is movably disposed in the cartridge case 12 and comprises a back end 11.1, an annular tubular body 11.2 attached to and extending forwardly from the back end 11.1, and a front end 11.3 on the annular tubular body 11.2 defining a front opening 11.4. The annular tubular body 11.2 of the thrust cage 11 has distributed over its circumference, and projecting from its back end 11.1, four fingers 11.5 separated from one another by narrow longitudinal gaps 11.6. The fingers 11.5 of the annular tubular body 11.2 encompass the circumference of the shell jacket 2 as well as the back plate 9 of the bullet core 3 which resides on the back end 11.1 of the thrust cage 11.

The shell jacket 2 of the bullet 1 is disposed in the annular tubular body 11.2 of the thrust cage 11 and has a front face 2.1 disposed adjacent to the front end 11.3 of the thrust cage 11, a rear face 2.2 spaced forwardly of the back end 11.1 of the thrust cage 11, respective forward and rearward portions 2.3, 2.4 connected together in a tandem arrangement with one another and extending between the front and rear faces 2.1, 2.2 of the shell jacket 2, and the axial bore 7 defined through the shell jacket 2 by the forward and rearward portions 2.3, 2.4 of the shell jacket 2 and longitudinally extending between the front and rear faces 2.1, 2.2 of the shell jacket 2. The bore 7 has a larger maximum cross-sectional size in the forward portion 2.3 than in the rearward portion 2.4 of the shell jacket 2 and defines front and rear openings 2.5, 2.6 in the shell jacket 2 at the front and rear faces 2.1, 2.2 thereof.

The four fingers 11.5 of the thrust cage 11 also encompass with their claw-like front ends 11.7 the front face 2.1 of the shell jacket 2 and therewith secure it axially. The thrust gage 11, in turn, is axially secured through a crimping 12.1 at the mount of the cartridge case 12. FIG. 1 depicts the above-described arrangement of the bullet 1. It is evident therefrom that the bullet head 3.1 in an initial pre-blast loaded state or form of the bullet 1 is largely sunk into the shell jacket 2 and does not project from the cartridge case 12. Not shown in FIG. 1 is the firing-pin termination of the cartridge with thrusting charge and primer.

Thus, the thrust cage 11 is disposed in the cartridge case 12 with the front end 11.3 of the thrust cage 11 located adjacent to the forward end 12.1 of the cartridge case 12. Also, thrust cage 11 is movable relative to the cartridge case 12 forwardly toward the entry end of the rifled barrel 13 of the shot gun in response to a blast generated in the cartridge case 12 rearwardly of and transmitted to the back end 11.1 of the thrust gage 11. Also, in response to the generated blast in the cartridge case 12 rearwardly of the back end 11.1 of the thrust cage 11 and the resulting forward movement of the thrust cage 11 relative to the cartridge case 12, the low-calibered bullet 1 in the thrust cage 11 is converted from the pre-blast position, shown in FIG. 1, providing the initial loaded form of the bullet 1 to a post-blast position, shown in FIG. 2, providing a final form of the bullet 1 shot from the gun. In the pre-blast position of the bullet 1 shown in FIG. 1, the bullet shaft 8 of the bullet core 3 extends rearwardly through and from the rear opening 2.6 of the shell jacket 2 and supports the back plate 9 of the bullet core 3 at a location spaced rearwardly of the bore 7 and the rear face 2.2 of the shell jacket 2 and adjacent the back end 11. 1 of the thrust cage 11, with the bullet head 3.1 disposed substantially within the bore 7 in the forward portion 2.3 of the shell jacket 2 and extending forwardly through the front openings 2.5, 11.4 of the shell jacket 2 and thrust cage 11. In the post-blast position of the bullet 1 shown in FIG. 2, the back plate 9 of the bullet core 3 is disposed exteriorly of and flush against an abutment defined by the rear face 2.2 of the shell jacket 2 being located rearwardly of the bore 7 of the shell jacket 2 and the bullet head 3.1 projects forwardly of the front face 2.1 of the shell jacket 2 and the front opening 2.5 therein.

When the cartridge 20 shown in FIG. 1 is fired, the gas pressure at the beginning of the blast generation accelerates the thrust cage 11. Thereby, the crimping 12.1 of the cartridge case 12 is torn open and the thrust cage 11 leaves the cartridge support 14 at the entry end of the rifled gun barrel 13 and enters the gun barrel 13. Simultaneously, the bullet core 3 comprised of the bullet head 3.1 and bullet shaft 8 moves forward while the shell jacket 2, due to its inertia, remains initially in its resting position. The bullet shaft 8 with its relatively sharp-edged offset 8.3 punches through the clamp disk 10 and subsequently is clamped by it when the back plate 9 of the bullet core 3 abuts the rear face 2.2 of the shell jacket 2. Thereby, the final form of the bullet 1 is established. This form is evident in FIG. 2 which depicts the bullet 1 already released from the thrust cage 11.

Figure 2:
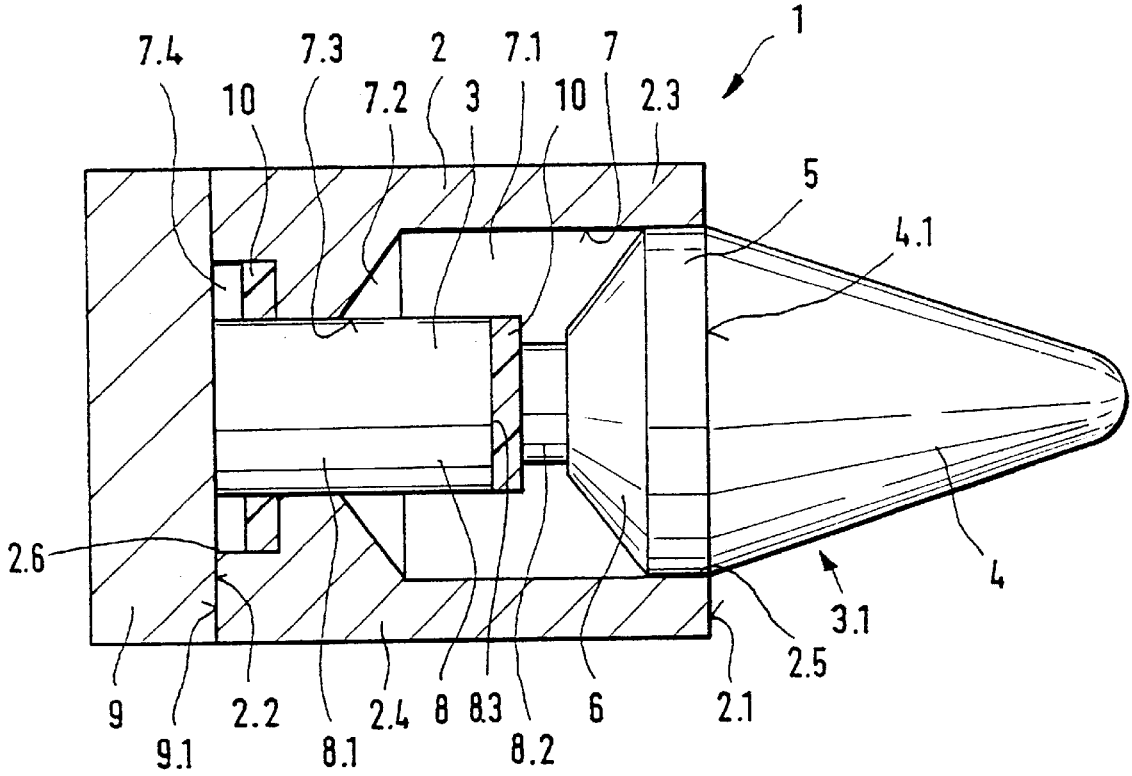
FIG. 2 is a view of the bullet similar to that in FIG. 1 but with the bullet now being shown in a final form after the generation of the blast.

The distance a between the front face 9.1 of the back plate of the bullet core 3 and the rear face 2.2 of the shell jacket 2 in the initial loaded state or position, as seen in FIG. 1, is equal to the distance b between the front face 2.1 of the shell jacket 2 and the base 4.1 of the cone point 4. This ensures that the cone point 4 of the bullet head 3.1 after the blast generation, as seen in FIG. 2, exits completely from the shell jacket 2. The front face 2.1 of the shell jacket 2 terminating with the base 4.1 of the cone point 4 forms simultaneously a caliber-size sharp edge at good ballistic form of the bullet 1.

Figure 3:
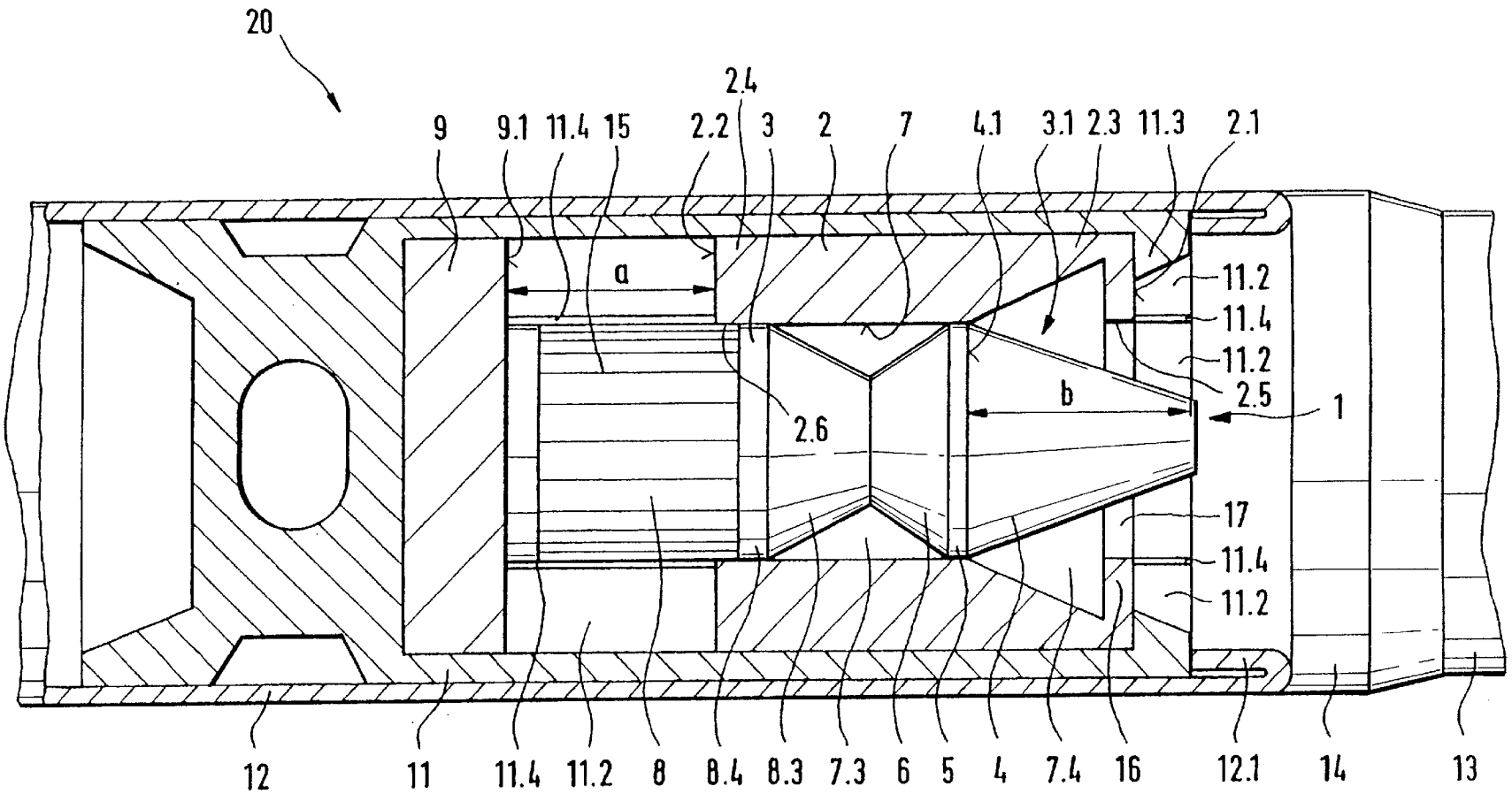
FIG. 3 is a view similar to FIG. 1 but of another embodiment of a shot gun cartridge of the invention with the bullet thereof being shown in the initial loaded form prior to generation of the blast.
Figure 4:
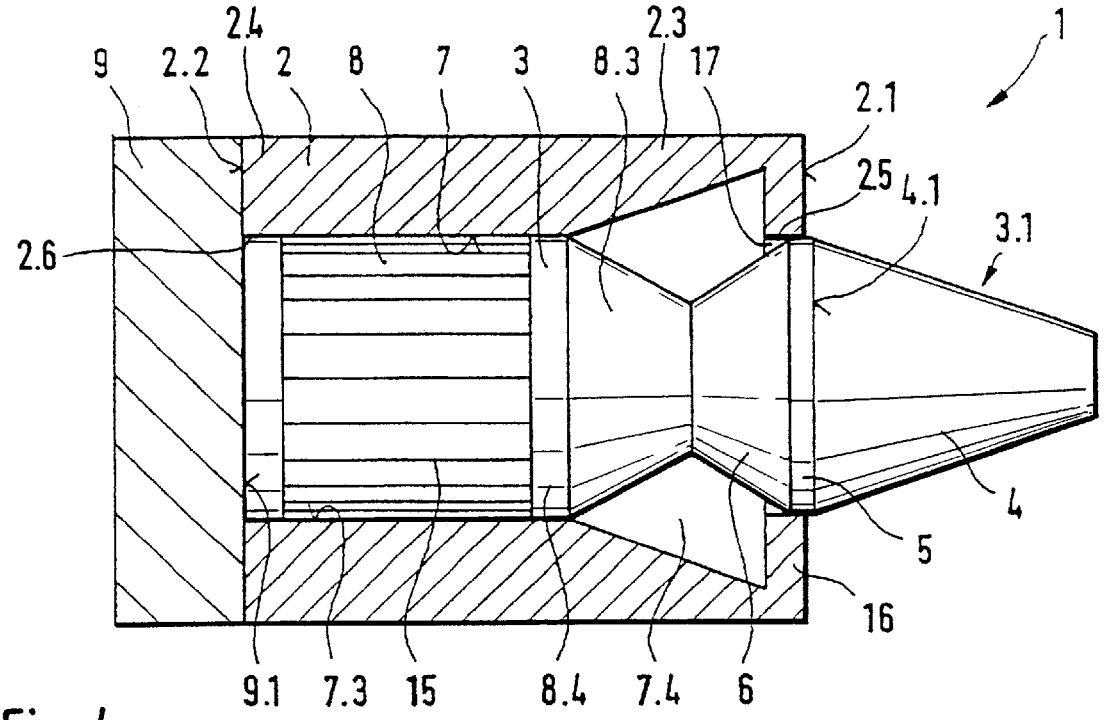
FIG. 4 is a view of the bullet similar to that in FIG. 3 but with the bullet now being shown in the final form after the generation of the blast.

In FIGS. 3 and 4 is depicted another embodiment of the bullet 1 of the invention. Identical or identically acting structural components in these Figures bear the same reference symbols as in the preceding embodiment of FIGS. 1 and 2.

The depicted bullet 1 also comprises a shell jacket 2, such as of copper, in which a bullet core 3 is disposed and axially displaceable relative to the shell jacket 2. The bullet 1 is disposed in a thrust cage 11 which, in turn, is disposed in a cartridge case 12. Since the disposition of the bullet 1 in the thrust cage 11 and in the cartridge case 12 is completely identical with the disposition according to FIG. 1, in order to avoid repetition reference is made to the above explanation in this respect.

The bullet core 3 is composed integrally of a bullet head 3.1 and a bullet shaft 8 with the bullet head 3.1 sequentially starting at the front comprising a slender point 4 in the form of a truncated cone, a cylindrical segment 5 and a rear truncated coneform segment 6. The bullet shaft 8 adjoins the truncated cone-form segment 6. This shaft 8 comprises a truncated cone-form transition portion 8.3 adjoining the segment 6 of the bullet head 3.1, which changes over into a cylindrical segment 8.4. At the end of this cylindrical segment 8.4 is developed integrally with it a back plate 9. The cylindrical segment 8.4 is provided with a knurling 15.

The shell jacket 2 comprises a throughbore 7 which comprises at the tail side a cylindrical segment 7.3 and at the forward side a conical segment 7.4 expanding toward the front. In this segment 7.4 the wall thickness of the shell jacket 2 is continuously decreased. It has its weakest site which represents a nominal buckling site, at the transition to a collar 16 bend inwardly at a right angle, which leaves open an opening 17 with the diameter of the cylindrical segment 7.3 of the throughbore 7.

The bullet core 3 in the loaded state or position shown in FIG. 3 is braced via the cylindrical segment 5 of the bullet head 3.1 and the upper end of the cylindrical segment 8.4 of the bullet shaft 8 on the inner wall of the cylindrical segment 7.3 of the throughbore 7 and is thereby fixed radially in the shell jacket 2. The axial fixing of the bullet core 3 in the shell jacket 2 takes place in the loaded position of the bullet 1 as shown in FIG. 3 where a short segment of the knurling 15 of the bullet shaft 8 is pressed into the inner wall of the cylindrical segment 7.3 of the throughbore 7 of the shell jacket 2, as is evident in FIG. 3. Thereby, the shell jacket 2 and bullet core 3 are fixed relative to one another, which provides reproducible conditions for the assembling of the bullet 1.

During a blast generation the processes explained in connection with the preceding embodiment take place. The sole difference comprises that here no clamp disk 10 is provided but that the knurling 15 of the bullet shaft 8 slides completely into the inner wall of the cylindrical segment 7.3 of the throughbore 7 of the shell jacket 2 whereby a very firm connection between the bullet core 3 and the shell jacket 2 is established.

At the end of the blast generation the bullet 1 has the final form shown in FIG. 4 with the bullet 1 already released from the thrust cage 11. It is evident based on this representation that the shell jacket 2 is closed at the forward side since the cylinder-form segment 5 of the bullet head 3.1 completely fills the opening 17 of the collar 16. This development and the slender truncated cone-form point 4 of the bullet head 3.1 lend the bullet 1 good external ballistic properties.

But the target-ballistic properties of this bullet 1 are also excellent. For example, it has great depth effect with very good mushrooming-out (cross section enlargement). Upon impinging on a target, the collar 16 bends inwardly at the nominal buckling site whereby the bullet 1 opens at its front face 2.1. Upon penetration of the target medium it can thereby press itself into the free space formed between the walls of the conical segment 7.4 of the throughbore 7, of the truncated cone-form segment 6 of the bullet head 3.1 as well as of the conical transition segment 8.3 of the bullet shaft 8. Thereby, promoted by the wall inclined outwardly of the conical segment 7.4, the upper margin region of the shell jacket 2 is turned outwardly, i.e. the bullet cross section is enlarged in the desired manner. Furthermore, due to the described mushrooming-out of the shell jacket 2 the slender bullet point 4, as a function of the degree of the deformation of the shell jacket 2, moves forwardly relative to it. Promoted by the spinning of the bullet 1, this causes in the target medium a straight-line shot channel such that this bullet 1 is less inclined than other bullets to become disposed transversely in the target or to tumble.

Figure 5:
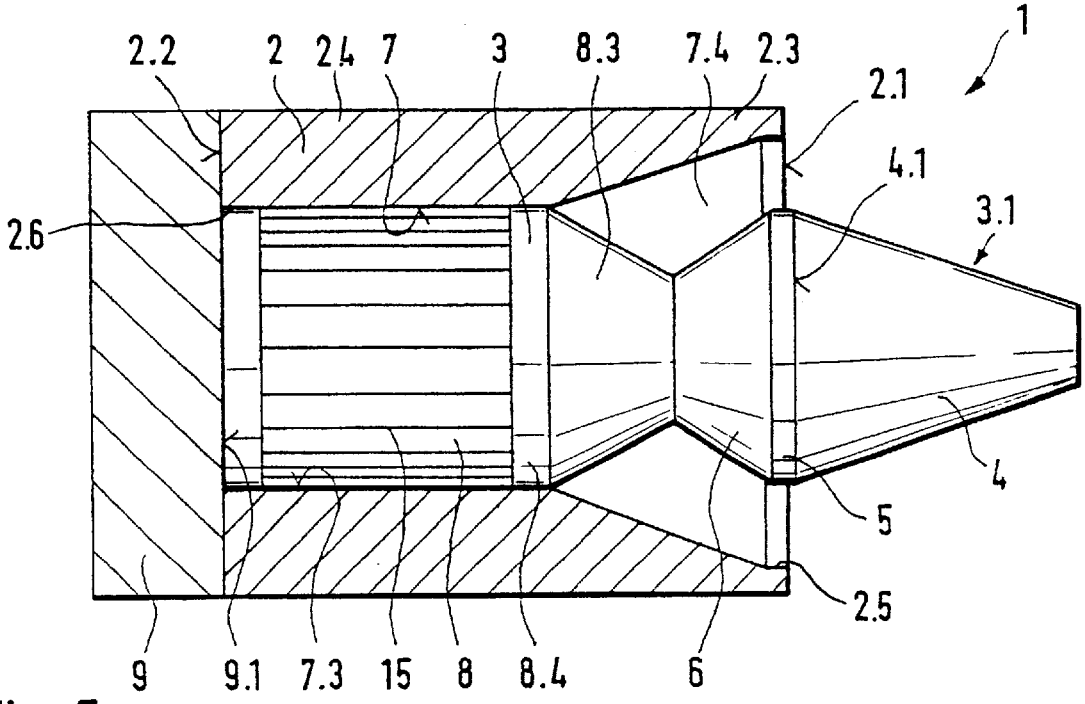
FIG. 5 is a view of a further embodiment of a bullet in the representation according to FIGS. 2 or 4, respectively.

In FIG. 5 a further embodiment of a bullet 1 according to the invention analogous to FIGS. 2 and 4 is shown. A representation of the bullet 1 in a thrust cage and cartridge case was omitted since it is completely identical with FIG. 3.

In the case of the bullet 1 shown in FIG. 5 the sole difference to the bullet of the preceding embodiments consists in that the collar 16 on the front face 2.1 has been omitted. Thus the shell jacket 2 here is open from the very outset at its forward end. Due to this development the mushrooming-out of the shell jacket 2 in the target occurs without delay, thus it is greater than in the preceding embodiments. This target-ballistic advantage is bought with a lesser depth effect and external ballistic disadvantages (air resistance, trajectory).

What is claimed is:

1. A shot gun cartridge for a rifled barrel of a shot gun, comprising:

(a) a cartridge case stationarily disposable in a shot gun and having a forward end locatable adjacent to an entry end of a rifled barrel of the shot gun;

(b) a thrust cage having a back end, an annular tubular body attached to and extending forwardly from the back end, and a front end on the annular tubular body defining a front opening, the thrust cage being disposed in the cartridge case with the front end of the thrust cage located adjacent to the forward end of the cartridge case, the thrust cage being movable relative to the cartridge case forwardly toward the entry end of the rifled barrel of the shot gun in response to a blast generated in the cartridge case rearwardly of and transmitted to the back end of the thrust gage; and (c) a sub-calibered bullet disposed in the thrust cage, the sub-calibered bullet including (i) a shell jacket disposed in the annular tubular body of the thrust cage and having a front face disposed adjacent to the front end of the thrust cage, a rear face spaced forwardly of the back end of the thrust cage, respective forward and rearward portions connected together in a tandem arrangement with one another and extending between the front and rear faces, and an axial bore defined through the shell jacket by the forward and rearward portions and longitudinally extending between the front and rear faces, the bore having a larger maximum cross-sectional size in the forward portion than in the rearward portion of the shell jacket and defining front and rear openings in the shell jacket at the front and rear faces thereof, and (ii) a bullet core including a front portion having a forwardly tapering configuration so as to provide a head extending forwardly through the bore in the forward portion of the shell jacket, a back portion larger in cross-sectional size than the front portion of the bullet core and the bore in the rearward portion of the shell jacket so as to provide a back plate, and an intermediate portion smaller in cross-sectional size than the bore in the forward and rearward portions of the shell jacket so as to provide a shaft extending through the rear opening of the shell jacket and between and interconnecting the head and back plate and adapted to guide slidable movement of the bullet core relative to the shell jacket from a pre-blast position providing an initial loaded form of the bullet, in which the shaft extends through and rearwardly of the rear opening of the shell jacket and supports the back plate at a location spaced rearwardly of the bore and the rear face of the shell jacket and adjacent the back end of the thrust cage with the head disposed substantially within the bore in the forward portion of the shell jacket and extending forwardly through the front openings of the shell jacket and thrust cage, to a post-blast position providing a final form of the bullet shot from the gun, in which the back plate is disposed rearwardly of the bore of the shell jacket and exteriorly of and flush against an abutment defined by the rear face of the shell jacket and the head projects forwardly of the front face of the shell jacket and the front opening therein, in response to the thrust cage being moved forwardly relative to the cartridge case in response the blast generated in the cartridge case rearwardly of the back end of the thrust cage.

2. The cartridge of claim 1 wherein the back plate of the bullet core has a cross-sectional size substantially the same as the cross-sectional size of shell jacket.

3. The cartridge of claim 1 wherein the shell jacket has a cylindrical configuration.

4. The cartridge of claim 1, further comprising:

means on the bullet core for holding the bullet core at the post-blast position relative to the shell jacket to stabilize the bullet core thereat at least until the bullet impinges on a target.

5. The cartridge of claim 4 wherein the holding means is a clamp plate slidably disposed about the intermediate portion of the bullet core for frictionally engaging both the bullet core and shell jacket at least when the bullet core is at the post-blast position relative the shell jacket.

6. The cartridge of claim 4 wherein the holding means is knurling on the intermediate portion of the bullet core for frictionally engaging the shell jacket at least when the bullet core is at the post-blast position relative the shell jacket.

7. The cartridge of claim 1 wherein the bullet core is made at least partially of a material harder than that of the shell jacket.

8. The cartridge of claim 1 wherein the cross-sectional size of the front opening of the shell jacket is only slightly larger than the maximum cross-sectional size of the forward portion of the bullet core such that the front opening of the shell jacket is substantially closed by the bullet core when the bullet core is at the post-blast position relative the shell jacket.

9. The cartridge of claim 1 wherein the cross-sectional size of the front opening of the shell jacket is larger than the maximum cross-sectional size of the forward portion of the bullet core such that an annular gap is formed between the bullet core and shell jacket when the bullet core is at the post-blast position relative to the shell jacket.

10. The cartridge of claim 1 wherein:

the shell jacket has an internal annular shoulder formed by the rearward portion of the shell jacket which reduces the bore to a smaller cross-sectional size in the rearward portion than in the forward portion of the shell jacket; and the bullet core has a maximum cross-sectional size larger than the cross-sectional size of the bore in the rearward portion of the shell jacket so as to abut the annular shoulder of the shell jacket when the bullet core is at the pre-blast position relative to the shell jacket.

11. The cartridge of claim 1 wherein the forward portion of the bullet core has a pair of reversely-arranged truncated cone segments.

* * * * *